US005125618A

United States Patent [19]

Sævoll

[11] Patent Number: 5,125,618

[45] Date of Patent: Jun. 30, 1992

[54] CASTING FORMWORK

[76] Inventor: Arnfinn Sævoll, Regine Normannsvei 8B, N-8014 Hunstadmoen, Norway

[21] Appl. No.: 576,476

[22] PCT Filed: Feb. 1, 1990

[86] PCT No.: PCT/NO90/00024

§ 371 Date: Oct. 1, 1990

§ 102(e) Date: Oct. 1, 1990

[87] PCT Pub. No.: WO90/08868

PCT Pub. Date: Aug. 9, 1990

[30] Foreign Application Priority Data

Feb. 3, 1989 [NO] Norway ..... 890446

[51] Int. Cl.[5] ..... E04G 9/02; E04G 17/04

[52] U.S. Cl. ..... 249/44; 249/43; 249/47; 249/190; 249/192; 249/195; 249/216; 249/219.1

[58] Field of Search ..... 249/43–45, 249/47, 189, 190, 191, 192, 195, 210, 216, 217, 219.1, 219.2

[56] References Cited

U.S. PATENT DOCUMENTS

| | | | |
|---|---|---|---|
| 2,480,840 | 9/1949 | Dicus | 249/47 |
| 2,948,046 | 8/1960 | Imonetti | 249/196 |
| 3,124,858 | 3/1964 | Blonde | 249/193 |
| 3,385,555 | 5/1968 | Williams | 249/192 |
| 3,550,898 | 12/1970 | Ursini | 249/195 |
| 3,862,737 | 1/1975 | Fuston, Jr. | 249/47 |

FOREIGN PATENT DOCUMENTS

| | | | |
|---|---|---|---|
| 637527 | 3/1962 | Canada | 249/192 |
| 1006676 | 3/1983 | U.S.S.R. | 249/191 |
| 859161 | 1/1961 | United Kingdom | 249/192 |

*Primary Examiner*—James C. Housel

*Attorney, Agent, or Firm*—Merchant, Gould, Smith, Edell, Welter & Schmidt

[57] ABSTRACT

Formwork structure for erecting continuous surfaces on one or both sides of a casting cavity. A formwork member with a plurality of openings defines the surface of the casting cavity. Form stays (32) extend through the openings in the formwork member surface into the casting cavity. Formwork stiffening members are located adjacent to the formwork member surface outside the casting cavity. The formwork members are arranged to define longitudinal and transversal mutually crossing channels with openings for receiving the form stays. The formwork members define the walls and base of the channels, which open outwardly away from the casting cavity. Side plates are connected to the formwork members at the edge of the formwork structure to create substantially rectangular structures. A rod-shaped connecting member is used to join adjacent sections of formwork structure. Arm crosses with a central opening for receiving the form stays are located in the crossing channels. The arm crosses have abutment projections which contact the base of the channel.

9 Claims, 7 Drawing Sheets

CASTING FORMWORK

Figure 1:
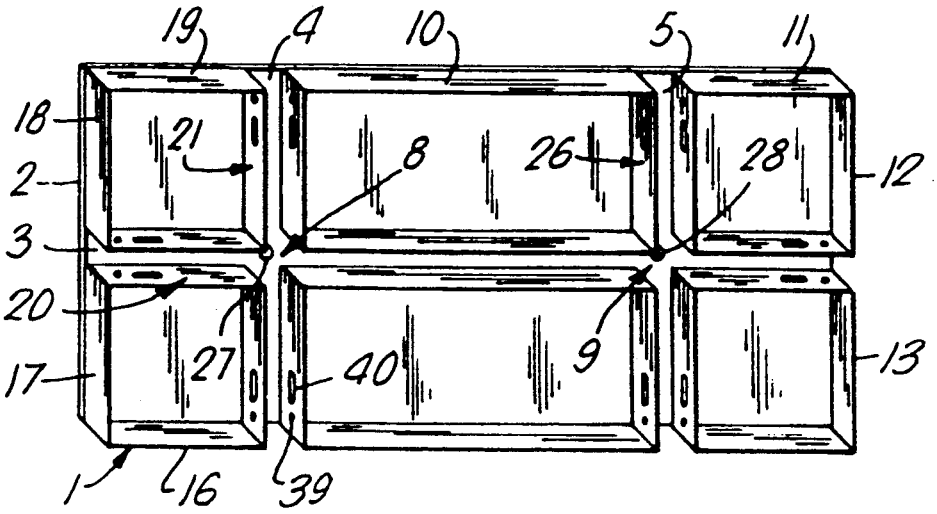

The invention relates to a formwork means, comprising formwork members for providing continuous surfaces on one or both sides of a casting cavity, and connecting means for connecting boarding members to form a formwork surface.

It is a special object of the present invention to provide a formwork means permitting a number of combinations as regards design and adaption. The formwork means should satisfy demands for few units, lightweight units or components, great strength, flexibility as regards design and adaption, simple mounting with or without utilization of a crane, and it should be possible to erect the formwork without use of tacks or the like. The formwork means should also be well suited for storage and simple in transport.

A special object of the formwork means is that it should be designed to permit the form stay pressure to be distributed in an advantageous manner all over the individual boarding members, so that maximum absence of moment in ends of formwork members is achieved. This is advantageous for connecting formwork members and in view of alignment beams which are mounted over the formwork member joints. According to the invention a formwork means is, thus, proposed, which comprises formwork members for building continuous surfaces on one or both sides of the casting cavity, and connecting means for connecting formwork members to form a formwork surface. The invention is characterized by the fact that a formwork member comprises a box shaped structure with a full wall (skin) on one side, whereas the other side has longitudinal and transversal grooves or channels, which are open towards the respective edges of the formwork member, with a through opening in the skin in each real or imagined crossing between longitudinal and transversal channels, and with a hole and an adjacent elongated hole in the channel walls at the edges of the formwork member, which holes/elongated holes form fastening means for the connecting means, that the connecting means are rod-shaped members which fit into said channels and are designed to be locked onto and connect adjacent formwork members by the aid of said holes/elongated holes, and by the fact that each formwork member has an associated arm cross to be placed on said channel cross, each arm cross having a central through opening which upon being placed is aligned with said through opening in the plate in the cross, and with the arms of said arm cross being provided with abutment projections on one plane side for abutment against the channel tops.

The box-shaped structure provides a relatively rigid formwork member. Said grooves or channels indicate how to place connection means as well as the reinforcing arm crosses. The abutment projections on the plane side of the arm cross provide for the desired distribution of the stay force to selected points on the boarding member. Utilization of arm crosses is also advantageous due to the fact that they compensate for the weakening which will be a structural consequence of the crossing channels. The channels permit a locking connection which is free of moment and can also be adjusted in length, and the rod shaped members (locking arms) to follow the framework sitting in the channels. Transmission of forces between boarding members is most advantageous because it occurs utilizing the frame members extending in the direction of forces.

The formed channels may advantageously also be used for placing wood elements which project from the formwork member, e.g. in connection with adaption to the terrain. The transition region is then boarded in a conventional manner by the aid of boards which are cut and secured to the wood elements. The crossing channels or grooves may weaken the formwork member, but this is fully compensated by reinforcement and load distribution provided by the arm crosses, absence of moments being achieved in the channel crossings as well. In an especially advantageous formwork means the length of the formwork member is twice its width, said member has two symmetrically arranged real or imagined channel crosses, and the distance from the centre of the arm cross to the respective abutment projections equals a quarter of the formwork member width. Such a formwork member will fit excellently into a system, in which the formwork members can be connected to form a desired formwork surface. The formwork members can, if desired, be placed in bond and they may "stand" or "lie" in the formwork surface. The symmetrical arrangement of channel crosses and the special dimensioning of said distance from the arm crosses and the special dimensioning of said distance from the arm cross centre to the respective abutment projections will provide absence of moments at the edges of formwork members. Consequently, said rod shaped members acting as locking arms for joining adjacent formwork members will not be subjected to moment loads.

In an especially preferred embodiment of the formwork means the grooves/channels are formed by crossing U-shaped channel profiles with a through opening in the channel crossing aligned with the opening in the skin.

Channel profiles will provide excellent stiffening of the formwork member, and in a preferred embodiment the channel profiles in the crosses are bound to the formwork member plate by the aid of a respective hollow bolt. Through the hollow bolts the form stays may be inserted.

The channel profiles preferably have outwards projecting beaded ends at the channel tops, so that longitudinal hook-shaped projections or flanges are provided for cooperation with suitable tensioning hooks for mounting alignment beams.

In an advantageous embodiment of the formwork means, especially as regards the design of the rod shaped members each rod shaped member is provided with transversal through holes of which at least one is an elongated hole. By the aid of said transversal through holes a rod shaped member or a locking arm may be connected with associated holes/elongated holes in the channel walls with desired tensioning by use of locking bolts and locking wedges.

A square cross section of channels, and a corresponding square cross section of locking arms would be advantageous to permit locking arms to be used two-ways.

To complete the formwork means it may comprise one or a number of formwork members which are centrally divided and hinged in the longitudinal direction. Such a hinged formwork member is advantageously used for an inner formwork member in a corner. Correspondingly, the formwork means may advantageously comprise one or a number of formwork members which are centrally hinged in the transverse direction. Such a formwork member is advantageously used to form an external boarding member at a corner.

The arm crosses are advantageously divided, i.e. they comprise two elongated members which are crossed to form the arm cross.

Required lateral alignment may be achieved by the aid of aligning beams, both vertically, and horizontally. Such alignment beams are attached along and across joints between formwork members by the aid of tensioning hooks which are made to engage said hooklike flanges along the channel tops and are, additionally, made to engage with hooklike flanges which are provided on the alignment beams.

An advantageous formwork for a wall may, e.g. comprise horizontal members (vertical short side) on one wall side and vertical formwork members on the other side. Alignment beams are placed along and across the joints on the short sides of the formwork members.

Figure 2:
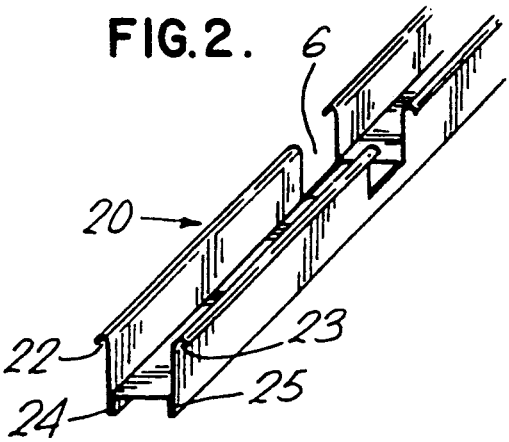
Figure 3:
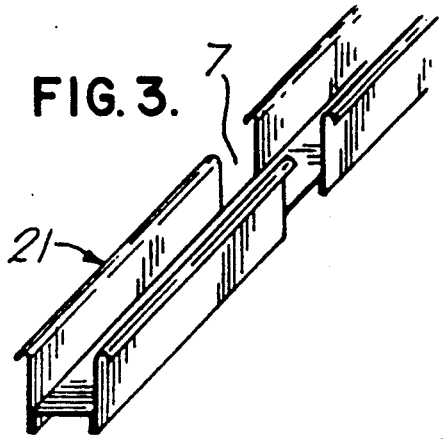
Figure 4:
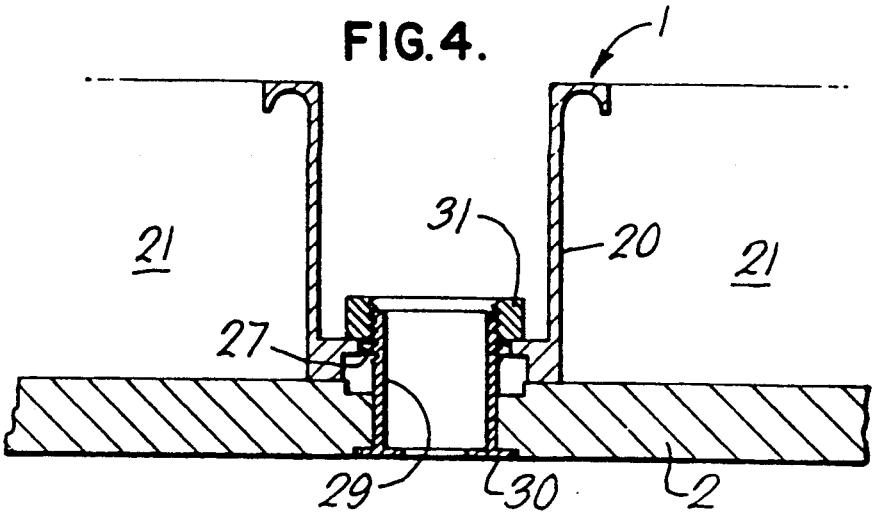
Figure 5:
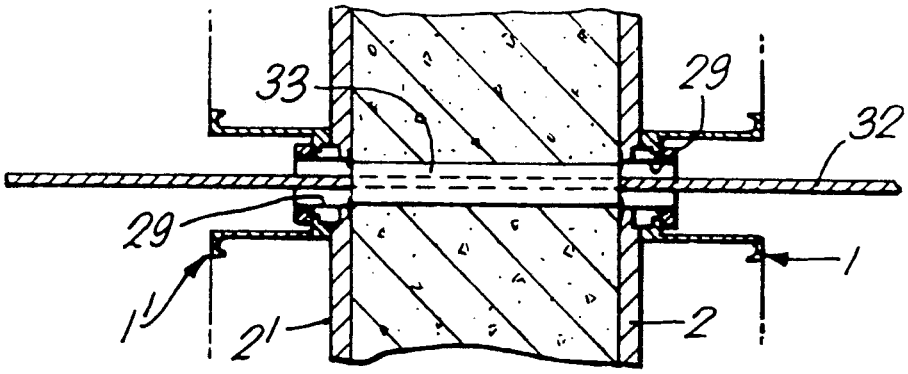
Figure 6:
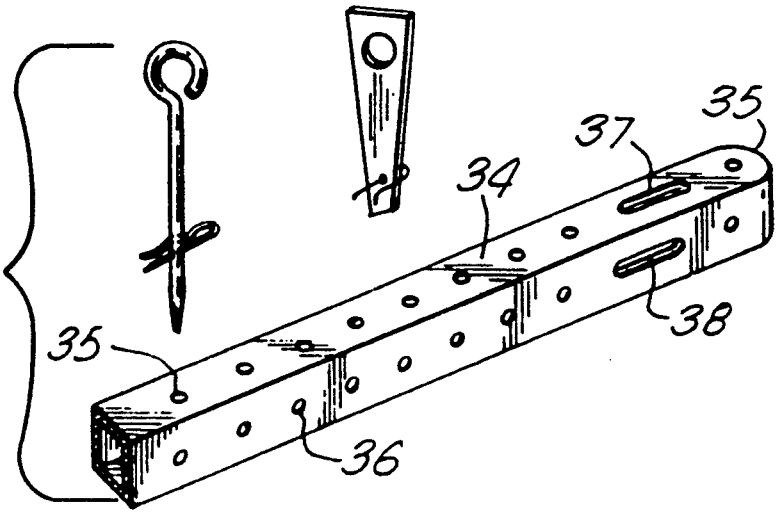
Figure 7:
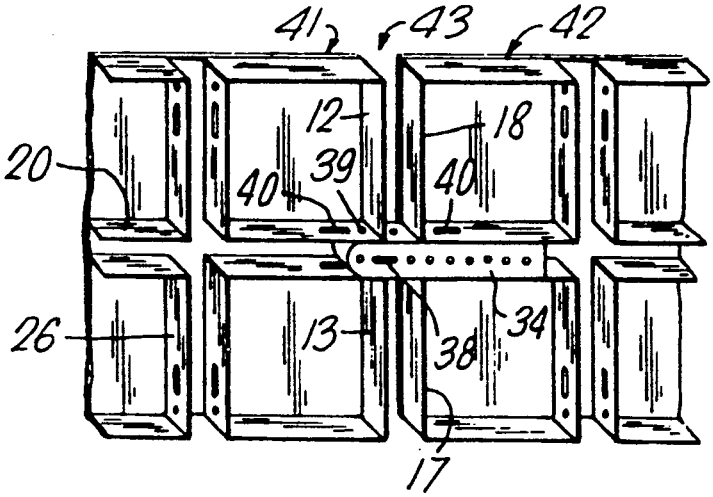
Figure 8:
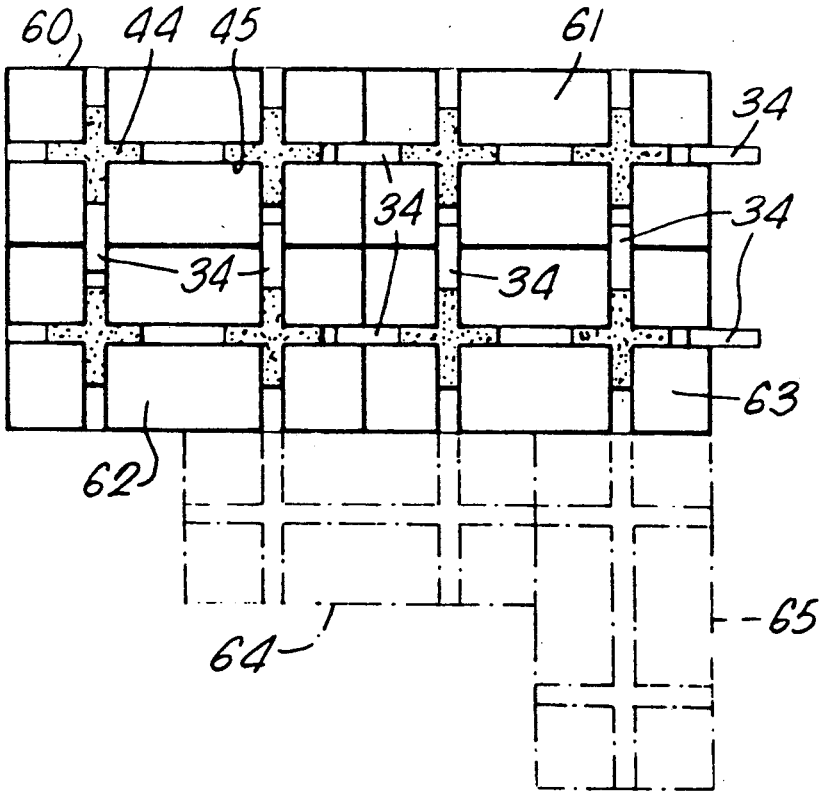
Figure 9:
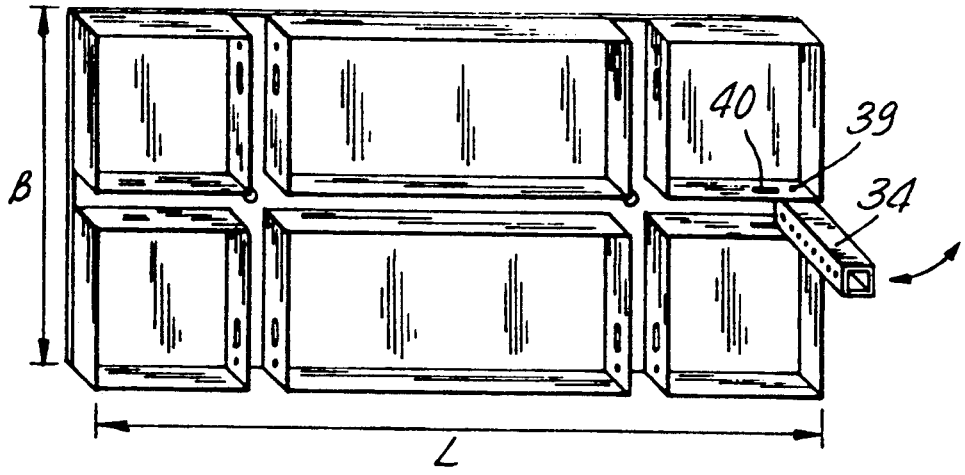
Figure 10:
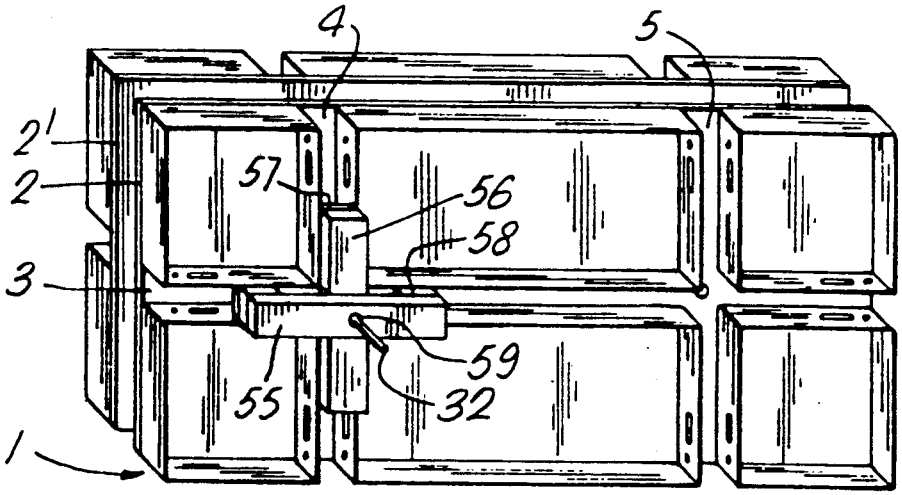
Figure 11:
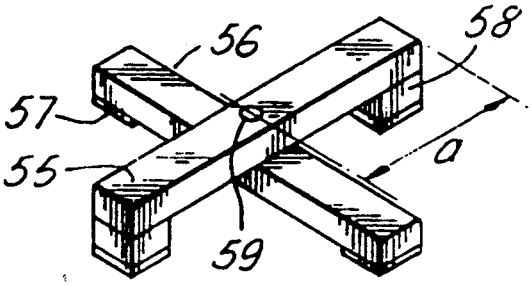
Figure 12:
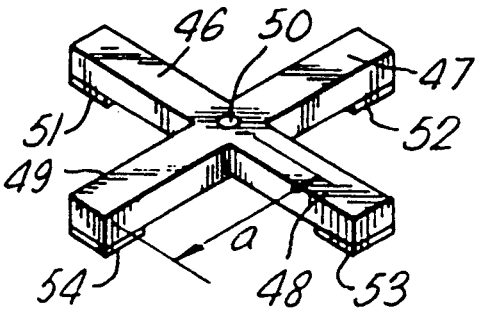
Figure 13A:
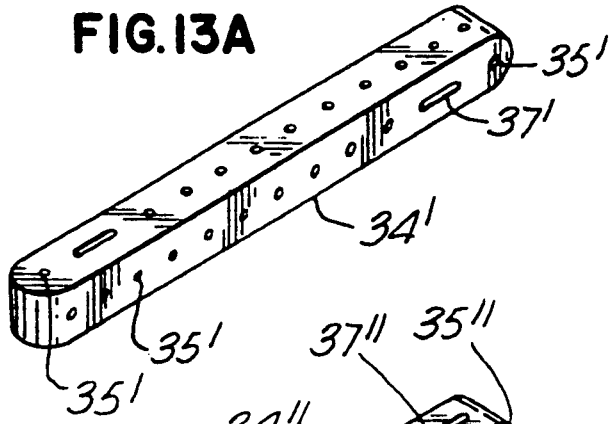
Figure 13B:
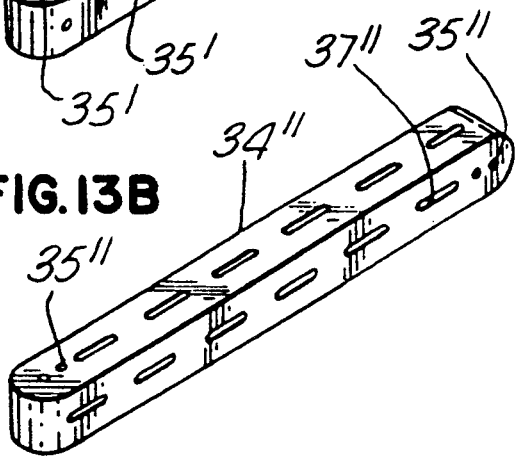
Figure 14:
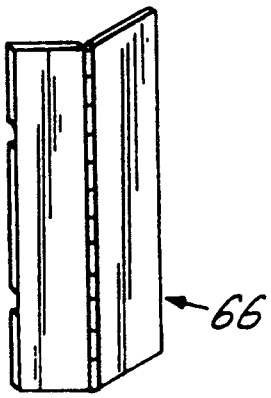
Figure 15:
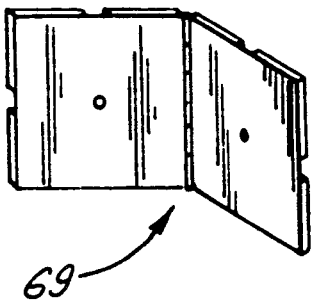
Figure 16:
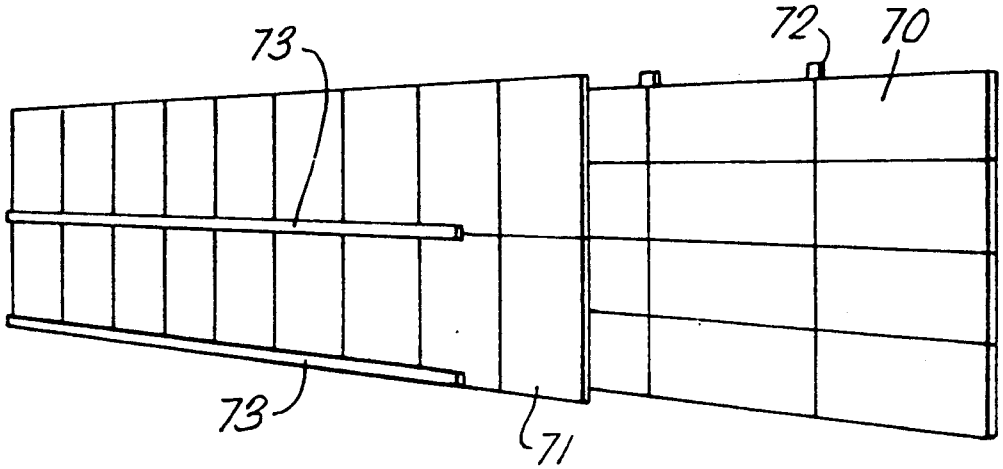
Figure 18:
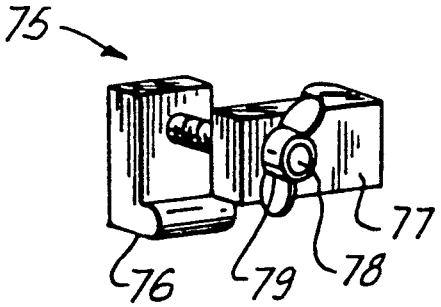
Figure 17:
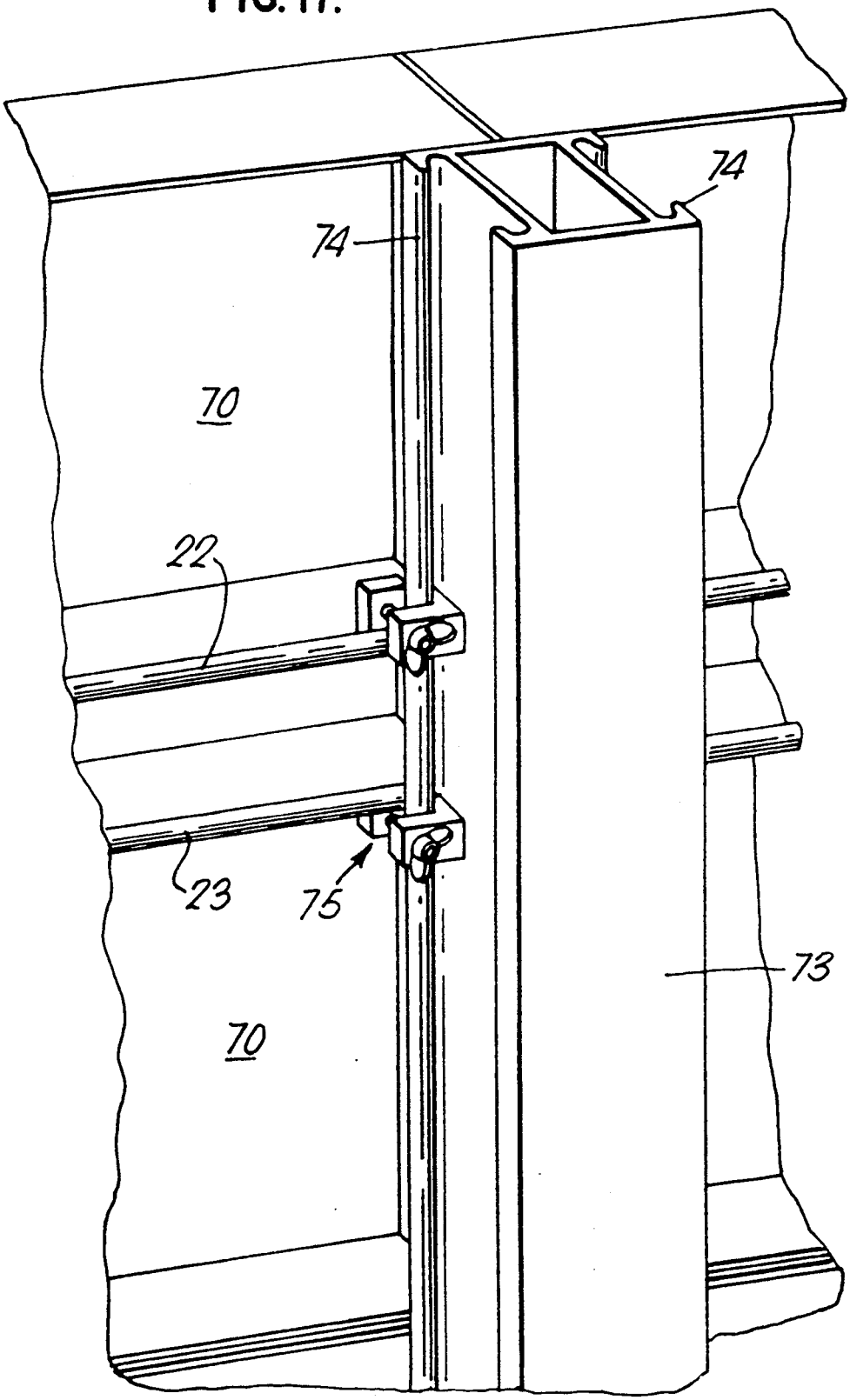

The invention is disclosed in more detail below with reference to the drawings, in which FIG. 1 is an elevation in perspective showing a formwork member from the outside, FIGS. 2 and 3 show sections of U-shaped channel profiles, recessed to be crossed, FIG. 4 is a section through a crossing with a hollow bolt to join channel profiles and plate in the crossing, FIG. 5 is a section through a cast with a formwork member on each side of the cast, and with form rods inserted through respective hollow bolts, FIG. 6 shows a locking arm with an associated locking bolt and a locking wedge, FIG. 7 is a partial view in perspective of two connected formwork members with an associated locking arm, FIG. 8 shows how a number of equal formwork members may be combined to form a formwork surface, FIG. 9 shows a formwork member like in FIG. 1 with a mounted locking arm, FIG. 10 shows the formwork member of FIG. 1, provided with an arm cross of the kind as shown in FIG. 11, FIG. 11 shows an arm cross, FIG. 12 shows another possible embodiment of an arm cross, FIGS. 13A and 13B shows two variants of a locking arm, FIG. 14 shows a formwork member which is hinged in the longitudinal direction, as seen from the inside, i.e. the side facing the cast, FIG. 15 shows a formwork member which is hinged in the transversal direction, as seen from the inside, i.e. the side facing the cast (skin side), FIG. 16 shows a partially completed formwork for a wall with alignment beams mounted across the formwork joints on their short sides, FIG. 17 is a partial view in perspective of how an alignment beam is mounted by the aid of tensioning hooks, and FIG. 18 is an elevational view in perspective of a tensioning hook.

The formwork member shown in FIG. 1 is a box shaped structure (cassette). This box shaped structure or cassette comprises a frame 1 and a coating or boarding plate 2 of a suitable material, e.g. plywood. As shown, frame 1 is designed to form mutually crossing grooves or channels 3, 4, and 5 on the side of the boarding member facing outwards. (The inside of the boarding member is the side where plate 2 is provided, which side faces the cast.) The frame may be built in various manners and may, e.g. be connected with the plate by screws.

It is not necessary that the channels cross as shown. The longitudinal walls of channels 3 may, e.g. be through walls, i.e. cross the transversal channels 4 and 5. If desired, the walls of channels 4 and 5 may cross channel 3.

An especially advantageous frame design comprises crossed U-shaped channel profiles of the kind shown in FIGS. 2 and 3. The channel profiles shown in FIGS. 2 and 3 are originally identical, but they are recessed in different manners at 6 and 7, respectively, so that they may be crossed to form channel crosses 8, 9 (see FIG. 1). The remaining frameside plates—10–19 may consist of sheet strips which are spot welded to channel profiles, or they may be L-profiles which are also spot welded to the channel profiles, and to each other, respectively where they abut at the corners of the formwork member.

As shown in FIGS. 2 and 3, each channel profile 20, and 21, respectively, has a U-shaped cross section with projecting hook-like or locking flanges 22, 23, and with two longitudinal bottom flanges or beads 24, 25. The object of bottom flanges 24, 25 is primarily to provide a connection in the longitudinal direction of channel profile 20 in the recessed area 6.

The crossed channel profiles 20, 21, and 26, respectively (see FIG. 1), are provided with a through opening 27, 28 in the crosses. Corresponding openings are made in plate 2. Reference is now made especially to FIGS. 4 and 5 in connection with a discussion of how the crossed channel profiles can suitably be connected with the plate.

FIG. 4 shows a section of plate 2. A hollow bolt 29 is inserted into through cross opening 27 and a corresponding opening in plate 2. Hollow bolt 29 has a flange 30 which is countersunk on the inside of plate 2. Hollow bolt 29 passes through opening 27 in the cross and outside the formwork member it is provided with a nut 31. In this manner framework and skin are held together in the crossing points. Bolt 29 is a hollow bolt to permit respective form stays to go through the centre of the cross, as shown in FIG. 5.

In FIG. 5 a sectional view of a cast is shown with a formwork member on each side. A stay 32 is extended through respective hollow bolts 29. A sleeve 33 is placed in the cast to surround the form stay and act as a distance holder. Stay 32 may in a suitable manner be provided with clamping means to hold both formwork members together at a desired distance. Before such clamping occurs, the respective arm crosses are placed each arm cross being provided with a central through opening for the stay.

FIG. 6 shows a so called locking arm 34. It is manufactured from a pipe having a square cross section and is provided with a plurality of through transversal holes 35, and 36, respectively, as well as with oblong holes 37, 38. Locking arm 34 is used to connect two adjacent boarding members, as shown in FIG. 7 (see also FIG. 8). In the walls of channel profiles 20, 21, 26 at the profile edges respective holes 39 and oblong holes 40 are provided. They serve for fastening locking arm 34. As shown in FIG. 9, locking arm 34 is inserted into the channel and attached to the formwork member a locking bolt (as shown in FIG. 6) being inserted through holes 39 in the channel walls and through through hole 35 placed outside oblong hole 37 at the end of the locking arm. Locking arm 34 is now locked to the formwork member and may be turned as indicated by the double arrow in FIG. 9.

In FIG. 7 two formwork members 41, 42 are shown to be joined at their short sides. Both formwork members 41, 42 are generally of the kind, as shown in FIGS. 1 and 9. FIG. 7 shows how locking arm 34 may be turned into an adjacent channel in formwork member 42, where it is firmly locked by a locking bolt of the kind as shown in FIG. 2, which is inserted into elongated hole 37, and through elongated holes 40 in both channel walls. Locking wedge is not shown in FIG. 7.

In FIG. 7 both formwork members 41, 42 are shown at a slight mutual distance (arrow 43), but said formwork members obviously are preferably provided tightly against one another in the joint. If necessary, an intermediate member may be inserted, e.g. when it is necessary to adjust the formwork dimension. If for some reason so large a distance 43 should be required between the joined boarding members that the elongated holes 37 and 40 are no longer aligned, locking arm 34 may be mounted in a different position, i.e. in a position in which the elongated hole 37 is aligned with elongated hole 40 of formwork member 41. The locking bolt, not shown, is then placed in two holes 39 of formwork member 42 and through an aligned hole 35 in locking arm. The cross section of the locking arm is adapted to the channel cross section, and the locking arm is in contact with the channel bottom.

The filler members which may be placed in the joint, may be of various designs, e.g. in the shape of an elongated member with a transversal recess receiving the locking arm. Such a filler members may be secured in many ways, e.g. by the aid of clamps, or the like, in a manner well known and obvious to those skilled in the art.

In FIG. 10 the formwork member of FIG. 1 (and FIG. 9) is shown with an arm cross 55, 56. The arm cross mounted in FIG. 10 is of the same kind as shown in FIG. 11.

This preferred embodiment of the arm cross, as shown in FIG. 11, comprises two elongated square arms 55, 56 which are placed one on top of the other and are provided with abutment projections 57, 58 of corresponding height. The arm cross in FIG. 11 has a central hole 59. Arm cross members 55, 56, thus, must not necessarily be connected but may be independent components positioned to form a cross when they are placed on the channel crosses. Such a design of two members is also advantageous because it permits individual elongated square members to be used for simple frame reinforcement when it is unnecessary or unsuitable to use the arm cross.

FIG. 12 shows a common arm cross with four arms 46–49 of equal length. The arm cross has a central through hole 50. On one plane side of the arm cross abutment projections 51–54 are provided at each free arm end, respectively. The abutment projections are intended for contact with the top of the U-shaped channel profiles. Hole 50 will be aligned with respective holes 27, 28 in the channel/plate of the channel cross.

In FIGS. 13A and 13B two variants of the locking arm are shown. One locking arm 34' has a plurality of holes 35' and an elongated hole 37', placed on opposite ends in the shown two elongated sides. The other locking arm 34'' has a plurality of elongated holes 37'' and two holes 35 at a respective end.

All formwork members shown in the Figures have a length L which is twice the width B of the formwork member (see FIG. 9). The channels are symmetrically arranged on the formwork member surface. The distance from the central hole in the arm cross and to the respective abutment projections in FIGS. 11 and 12, designated a, is a quarter of the width B of the formwork member.

In FIG. 10 two identical formwork members are provided with the plate sides 2, 2', respectively facing each other. Both formwork members are identical. A section through a cross area, e.g. the at left hand side in FIG. 10, is shown in FIG. 5. As mentioned, a spacer sleeve 33 is inserted between said formwork members and a stay is inserted through the sleeve to extend through respective hollow bolts 29 which hold frame and plate together. The arm cross is then inserted on the stay and is adapted over the channel grooves. In a suitable manner, e.g. by tightening nuts with washers on stay 32, both formwork members are clamped together to form a two-side formwork. The clamping force will be distributed to selected points on the surface of the formwork member, via said abutment projections on the cross arms. This means that the clamping force provided by e.g. stay 32 centrally in a channel cross will be distributed to four points on the surface of the formwork member, i.e. where abutment projections are in contact with channel tops. Consequently, forces are induced which act at a distance B/4, as calculated from the arm cross centre. The arm cross acts like a frame reinforcement distributing the stay pressure to four points on the formwork members with such a distribution that all ends of the formwork members are free of any moments. This is advantageous with respect to the locking arms 24, which will, thus, be free of any moments.

FIG. 8 shows how four formwork members 60, 61, 62, and 63 may be combined to form a formwork surface. Each formwork member 60–63 is designed like the formwork member shown in FIG. 1. Arm crosses 44 and 45 are in place and the separate formwork members are locked together by the aid of locking arms 34 in the manner disclosed above, see FIGS. 7 and 9 and description of said Figures. At the right hand side in FIG. 8 two locking arms 34 are shown to be turned outwards ready for connection with further formwork members.

Dashed lines indicate how additional formwork members 64, 64 may be added, and it will appear that the formwork members may, thus, be bonded, or may "lie" and/or "stand", respectively.

For casting corners formwork members which are divided and hinged longitudinally (FIG. 14), and transversally (FIG. 15), may be used. Apart from the hinging, the formwork members of FIGS. 14 and 15 are designed like the formwork members of FIG. 1. Other variants are obviously possible as well. Two formwork members of the kind as shown in FIG. 1 may, e.g. be hinged along two opposite longitudinal sides.

The standing formwork must be strengthened. This may be done as shown in FIGS. 16 and 17.

FIG. 16 shows a partly completed wall formwork, in which a number of formwork members 70 are mounted horizontally on one wall side and a number of formwork members 71 are mounted vertically on the other side. Across the joints of short sides aligning beams 72, and 73, respectively, are provided. Thus, the wall formwork is aligned horizontally and vertically. FIG. 17 shows how an alignment beam 72 is mounted. Alignment beam 73 is box shaped with longitudinal hook flanges 74. By the aid of clamping hooks 75, see FIG. 18, the beam is locked to the respective formwork members, the clamping hooks being engaged as shown, by the aid of their two clamping cheeks 76 and 77 in hook flange 74 and in hook flanges 22, 23 (see FIG. 2). Clamping hooks are mutually tensioned by screw 78 which is attached to hook 76, passes freely through hook 77 and is provided with a wing nut 79. In FIG. 16 channel profiles, locking arms, and arm crosses are omitted to facilitate survey.

The material used in the frame of formwork members is advantageously aluminium, as mentioned, or a suitable alloy of aluminium. A corresponding material is advantageously also used for locking arms and arm crosses as well as for the vertical stiffening beams and for other components, e.g. the above indicated filler components. The formwork member plate is preferably made from plywood. A suitable plywood thickness is between 15 and 18 mm for a formwork member having main dimensions 620×1240 mm (B×L).

If a medium aluminium grade is used, a formwork member of 620×1240 mm, with a 15 mm thick skin plate and an aluminium frame, as shown, will have a weight of 12–13 kg. This will be the heaviest component of the formwork means. This formwork means is, thus, very suitable for being lifted by one person. The formwork means constitutes a flexible and simple formwork system, which can readily be mounted and comprises a limited number of components which are all readily handled separately.

The plate of the formwork members may also for certain applications more advantageously consist of a transparent material, e.g. acrylic plate, which is especially advantageous in case of repair casting, because it permits observation through the plate to ensure that the cast is correct.

I claim:

1. A formwork structure for erecting continuous surfaces to substantially enclose a casting cavity, comprising:

a formwork member surface (2) with a plurality of openings defining the surface of the casting cavity;

form stays (32) extending through said opening in said formwork member surface into the casting cavity;

formwork stiffening members located adjacent to said formwork member surface outside the casting cavity, said formwork members arranged to define longitudinal and transversal mutually crossing channels (3, 4, 5) with openings (27, 28) in said crossing channels for receiving said form stays (32), said formwork members defining the walls and base of said channels to open outwardly from the casting cavity, whereby said formwork member surface is supported;

side plates (10–19) connected to said formwork members at the edges of said formwork structure to create substantially rectangular structures;

connecting means (34) located in said channels for connecting adjacent formwork structures; and arm crosses (55, 56) with a central through opening (50; 59) for receiving said form stays (32) which are located in said crossing channels, said arm crosses having abutment projections (57, 58) which contact said base of said channel.

2. A formwork structure of claim 1, characterized in that the formwork member surface has a length (L) which is twice its width (B), that said formwork member surface has two symmetrically placed channel crosses (8, 9), and that the distance (a) from the center (59) of each arm cross to the respective abutment projections (57, 58) corresponds to a quarter of the formwork member surface width (B).

3. A formwork structure of claim 1 wherein said formwork members have a U-shaped channel profile (20, 21) with a through opening in said base of said channel crossing aligned with one of said openings in said formwork member surface.

4. A formwork structure of claim 3, characterized in that said channel profiles (20, 21) have outwardly-projecting hook-forming edge flanges (22, 23) along the outward edges of said channel walls.

5. A formwork structure of claim 3, characterized in that said channel profiles (20, 21) in the crossings are connected with the formwork member surface (2) by a hollow bolt (29).

6. A formwork structure of claim 1 characterized in that said connecting means includes a rod-shaped member (34) provided with through transversal holes (35), of which at least one is an oblong hole (37), and that there is a hole (39) and an adjacent oblong hole (40) in said channel walls at the edges of the formwork member surface.

7. A formwork structure of claim 6 wherein said rod shaped member has square cross section substantially equal in size to said channels.

8. A formwork structure of claim 1 characterized in that the arm cross consists of two elongated members (55, 56), one of which is placed crosswise on the other.

9. A formwork structure of claim 1 wherein alignment beams (72, 73) are mounted to said formwork members by longitudinal hook-forming edge flanges (74).

* * * * *